US005115781A

United States Patent [19]

Kurita et al.

[11] Patent Number: 5,115,781

[45] Date of Patent: May 26, 1992

[54] AIR-FUEL RATIO CONTROLLER FOR INTERNAL COMBUSTION ENGINE

[75] Inventors: Noriaki Kurita, Nagoya; Masakazu Ninomiya; Kazunori Kishita, both of Kariya, all of Japan

[73] Assignee: Nippondenso Co., Ltd., Kariya, Japan

[21] Appl. No.: 693,092

[22] Filed: Apr. 30, 1991

Related U.S. Application Data

[63] Continuation of Ser. No. 406,725, Sep. 12, 1989, abandoned.

[30] Foreign Application Priority Data

Sep. 13, 1988 [JP] Japan ..... 63-229186

[51] Int. Cl.[5] ..... F02M 51/00

[52] U.S. Cl. ..... 123/481; 123/440

[58] Field of Search ..... 123/489, 440, 488; 364/431.06

[56] References Cited

U.S. PATENT DOCUMENTS

| | | | |
|---|---|---|---|
| 4,870,586 | 9/1989 | Asakura et al. | 123/489 |
| 4,870,938 | 10/1989 | Nakaniwa | 123/489 |
| 4,873,642 | 10/1989 | Mieno et al. | 123/489 |
| 4,878,472 | 11/1989 | Nibino | 123/489 |
| 4,941,448 | 7/1990 | Nakaniwa et al. | 123/488 |
| 4,958,612 | 9/1990 | Kato et al. | 123/489 |
| 4,981,125 | 1/1991 | Kato et al. | 123/440 |

FOREIGN PATENT DOCUMENTS

| | | | |
|---|---|---|---|
| 0182073 | 12/1986 | European Pat. Off. | 123/489 |
| 3704691 | 8/1987 | Fed. Rep. of Germany | 123/489 |
| 2479908 | 4/1981 | France | 123/489 |
| 51-140021 | 12/1976 | Japan | 123/489 |
| 55-84831 | 6/1980 | Japan | 123/489 |
| 56-21900 | 5/1981 | Japan | 123/489 |
| 58-4177 | 1/1983 | Japan | 123/489 |
| 60-32950 | 2/1985 | Japan | 123/489 |
| 60-144656 | 7/1985 | Japan | 123/489 |
| 62-162747 | 7/1987 | Japan | 123/489 |
| 2050004 | 12/1980 | United Kingdom | 123/489 |
| 2064170 | 6/1981 | United Kingdom | 123/489 |

*Primary Examiner*—Raymond A. Nelli

*Attorney, Agent, or Firm*—Cushman, Darby & Cushman

[57] ABSTRACT

A relation with output characteristic of an oxygen density sensor corresponding to a deviation of an air fuel ratio of a mixed gas supplied actually to an internal combustion engine from a desired air fuel ratio is stored beforehand in an air fuel ratio controller of the present invention. Then, the air fuel ratio deviation is computed correspondingly to an actual output of the oxygen density sensor according to the stored relation, and an air fuel ratio controlled variable is corrected according to the computed air fuel ratio deviation, thereby controlling the air fuel ratio to the desired air fuel ratio. Further, a change in output characteristic of the oxygen density sensor to the air fuel ratio is detected, then the output characteristic of the oxygen density sensor stored beforehand is corrected according to the detection result, and thus if the output characteristic of the oxygen density sensor fluctuates due to a deterioration arising on the oxygen density sensor, the air fuel ratio controlled variable will be decided in consideration of the fluctuation.

22 Claims, 8 Drawing Sheets

START
POWER ENRICHMENT ?
200
NO
YES
READ OX
201
|OX-OXO| = K ?
202
NO
YES
CPW ← 0
210
CPW ← CPW+1
203
CPW ≧ CO ?
204
NO
YES
(V1+V2)/2 ≦ OX ?
205
NO
YES
SELECT PATTERN ①
206
(V2+V3)/2 ≦ OX ?
207
NO
YES
SELECT PATTERN ②
208
SELECT PATTERN ③
209
OXO ← OX
211
END

FIG. 11

| | | OX | | | |
|---|---|---|---|---|---|
| | | $OX_1$ | $OX_2$ | -------- | $OX_m$ |
| | $\nabla PW_1$ | $\Delta\lambda_{11}$ | $\Delta\lambda_{12}$ | -------- | $\Delta\lambda_{1m}$ |
| $\nabla PW$ | $\nabla PW_2$ | $\Delta\lambda_{21}$ | $\Delta\lambda_{22}$ | -------- | $\Delta\lambda_{2m}$ |
| | ⋮ | ⋮ | ⋮ | ⋱ | ⋮ |
| | $\nabla PW_n$ | $\Delta\lambda_{n1}$ | $\Delta\lambda_{n2}$ | -------- | $\Delta\lambda_{nm}$ |

AIR-FUEL RATIO CONTROLLER FOR INTERNAL COMBUSTION ENGINE

This is a continuation of application Ser. No 07/406,725, filed on Sep. 12, 1989, which was abandoned upon the filing hereof.

BACKGROUND OF THE INVENTION

1. Field of the invention

The present invention relates to an air fuel ratio controller for internal combustion engine, wherein an oxygen density in exhaust gas of an internal combustion engine is detected by an oxygen density sensor (hereinafter called "$O_2$ sensor"), an air fuel ratio of a mixed gas to be supplied to the internal combustion engine is subjected to a feedback control, for example, to a theoretical air fuel ratio or around.

2. Description of the Prior Art

A prior art way of controlling an air fuel ratio is disclosed in Japanese Patent Laid-Open No. 140021/1976, wherein an $O_2$ sensor output corresponding to an $O_2$ sensor output voltage is integrated in consideration of an output characteristic of an $O_2$ sensor installed on an exhaust system of an internal combustion engine to an air fuel ratio, and a fuel quantity is corrected according to the integration output, thus when actual air fuel ratio is disordered appreciably from a theoretical air fuel ratio, the fuel quantity is quickly adjusted, and when actual air fuel ratio approximates the theoretical air fuel ratio, the fuel quantity is gradually adjusted.

Meanwhile, such mode of control as disclosed above is still based on the condition that the output characteristic of the $O_2$ sensor to air fuel ratio is always constant, however, the output characteristic fluctuates due to a deterioration of the $O_2$ sensor practically, therefore a controllability desired on initial design cannot be maintained at the time of change in $O_2$ sensor, thus causing a deterioration of emission.

Accordingly, an object of the invention is to provide an air fuel ratio controller for internal combustion engine capable of ensuring a control precision satisfactory to a desired air fuel ratio regardless of a change arising in the output characteristic of the $O_2$ sensor due to deterioration or the like thereof.

SUMMARY OF THE INVENTION

In order to solve the aforementioned problems and also to attain the object, the invention purports an air fuel ratio controller for internal combustion engine, comprising:

an oxygen density sensor provided on an exhaust system of internal combustion engine for and generating a signal according to an air fuel ratio of a mixed gas supplied to the engine upon detection of an oxygen density in an exhaust gas of the internal combustion engine;

memory means for storing beforehand a relation between a deviation of an air fuel ratio of the mixed gas supplied as above from a desired air fuel ratio and an output of the oxygen density sensor according to an output characteristic of the oxygen density sensor to an air fuel ratio of the mixed gas supplied to the engine;

Air fuel ratio deviation deciding means for obtaining an air fuel ratio deviation corresponding to an output of the oxygen density sensor according to the relation stored in the memory means;

controlled variable setting means for setting an air fuel ratio controll variable according to the deviation decided by the air fuel ratio deviation deciding means;

air fuel ratio control means for controlling an air fuel ratio of mixed gas to be supplied to the engine according to the air fuel ratio, control variable set by the controll variable setting means;

characteristic change detection means for detecting change in the output characteristic of the oxygen density sensor in a case of the same air fuel ratio;

correction means for correcting the relation stored in memory means corresponding to a detected result of the characteristic change detection means.

According to the aforementioned construction, an air fuel ratio controlled variable is determined according to an air fuel ratio deviation obtainable through the relation between a deviation of an actual air fuel ratio from a desired air fuel ratio stored in the memory means and an oxygen density sensor output, and the air fuel ratio of a mixed gas supplied to the engine is subjected to a feedback control to a desired air fuel ratio.

Further, when change in an output characteristic of the oxygen density sensor is detected, the aforementioned relation is corrected by the correction means, thus an air fuel ratio deviation decided by the air fuel ratio deviation deciding means is maintained in precision at all times, thereby keeping a satisfactory control precision to a desired air fuel ratio.

BRIEF DESCRIPTION OF THE DRAWINGS

FIG. 11 is a table showing a content of the map used in the process illustrated in FIG. 10.

DETAILED DESCRIPTION OF PREFERRED EMBODIMENTS

The invention will now be described with reference to the accompanying drawings representing one embodiment thereof.

Figure 1:
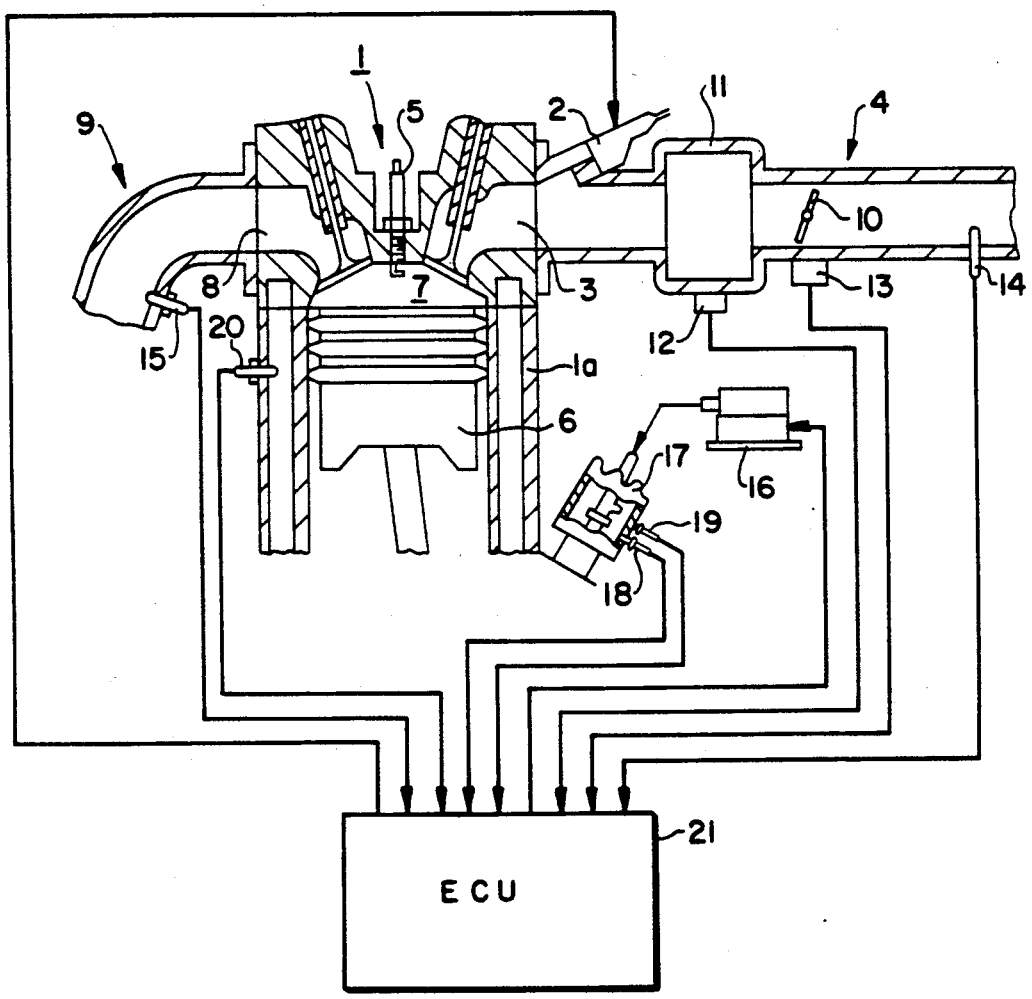
FIG. 1 is a block diagram representing a configuration of an engine provided with one embodiment of the invention and its peripheral equipment.

FIG. 1 is a schematic system diagram representing a car internal combustion engine (hereinafter called "engine") on which an air fuel ratio controller embodying the invention is mounted and its peripheral equipment.

An engine 1 comprises an intake system 4 for sucking in the air, mixing a fuel injected by a fuel injection valve 2 and the air and introducing a mixed gas to an intake port 3, a combustion chamber 7 for extracting a combustion energy of the mixed gas ignited on an ignition plug 5 through a piston 6 as a rotational motion, and an exhaust system 9 for exhausting a gas after combustion through an exhaust port 8.

The intake system 4 then comprises an air cleaner (not indicated) for taking in the air therethrough, a throttle valve 10 for controlling an intake air rate, a surge tank 11 for smoothing a plusation of the intake air and others, and an intake pressure sensor 12 for detecting an intake pipe negative pressure is provided on the surge tank 11. The intake air rate is controlled by an opening of the throttle valve 10 interlocking with an accelerator pedal (not indicated). Then, other than the intake pressure sensor 12, the intake system 4 is provided with a throttle position sensor 13 having an opening sensor 13*a* (FIG. 2) for generating a signal according to an opening of the throttle valve 10, and an idling switch 13*b* (FIG. 2) which is turned on when the engine 1 runs idle, an intake temperature sensor 14 and others.

An electromotive force type oxygen density sensor (called "$O_2$ sensor" hereinafter) 15 for detecting oxygen density in an exhaust gas is provided on the exhaust system 9. The ignition plug 5 provided on each cylinder of the engine 1 is connected to a distributor 17 for producing a high voltage generated on an ignitor 16 synchronously with rotations of a crankshaft (not indicated). A rotational frequency sensor 18 for generating a pulse according to a rotational frequency NE of the engine 1 and a cylinder discrimination sensor 19 are provided on the distributor 17. Then, a cylinder block la of the engine 1 is cooled by a circulating cooling water, and temperature of the cooling water which is one of parameters for operating state of the engine 1 is detected by a cooling water temperature sensor 20 provided on the cylinder block 1*a*.

Figure 2:
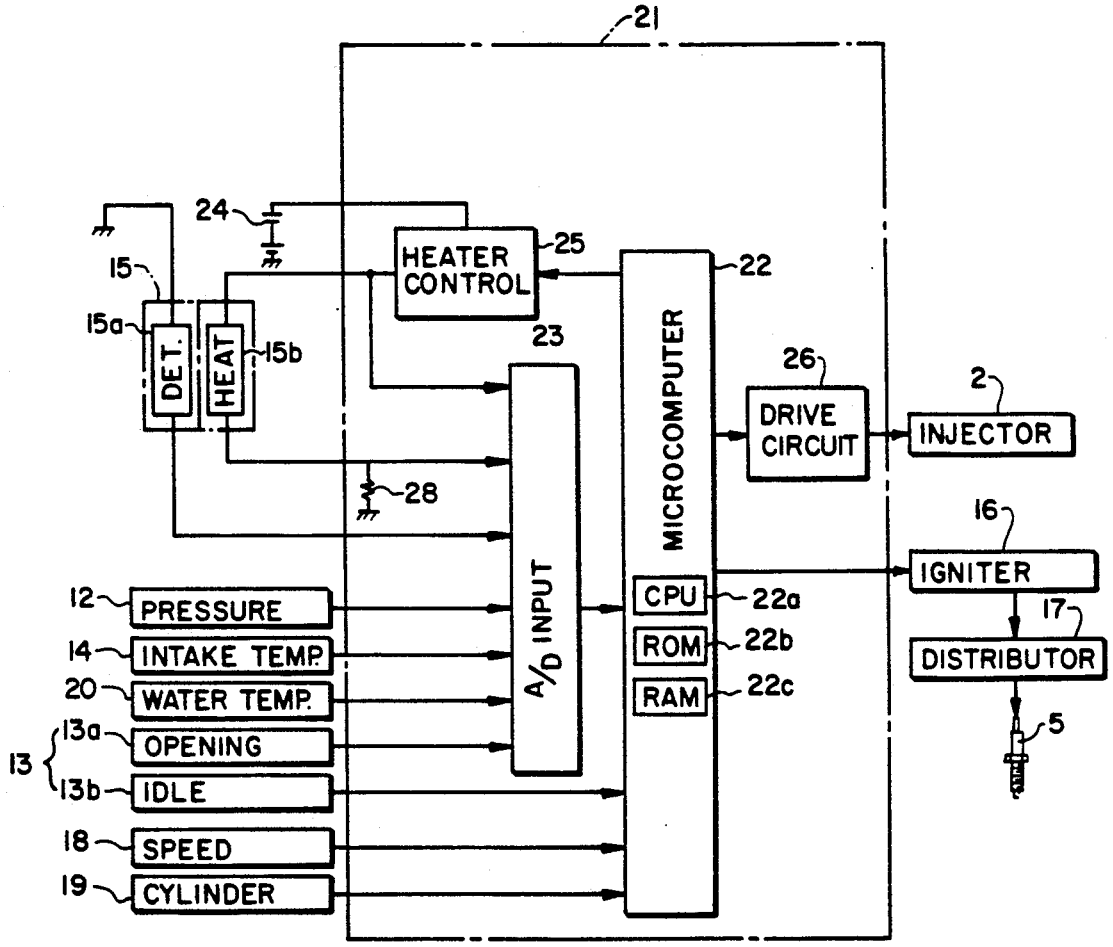
FIG. 2 is a block diagram representing a configuration of the control circuit illustrated in FIG. 1.

Each sensor signal for detecting an operating state of the engine 1 is inputted to an electronic control circuit (hereinafter called "ECU") 211 and used for control of a fuel injection rate of the fuel injection valve 2, control of an ignition timing of the ignition plug 5 and others. As shown in FIG. 2, ECU 21 is constructed around a one-chip microcomputer 22 incorporating a central processing unit(CPU) 22*a*, a read-only memory (ROM) 22*b*, a random access memory (RAM) 22*c* and others. The rotational frequency sensor 18, the cylinder discrimination sensor 19, the ignitor 16 are connected directly to input/output ports of the microcomputer 22, and an A/D conversion input circuit 23 within the microcomputer 22, a heater conduction control circuit 25 for controlling a power for conducting a heater 15*b* for heating a detecting element 15*a* of the $O_2$ sensor 15 at constant temperature 600° C. or so with a battery 24 as a power source, and a driving circuit 26 for driving the fuel injection valve 2 are also connected thereto.

Sensors such as intake pressure sensor 12, opening sensor 13*a* of the throttle position sensor 13, intake temperature sensor 14, cooling water temperature sensor 20 and others which generate analog signals are connected to the A/D conversion input circuit 23. Accordingly, CPU 22*a* is capable of getting various parameters reflecting an operating state of the engine 1 successively from reading them through the A/D conversion input circuit 23. Then, an output of the heater conduction control circuit 25 for impressing a voltage on the heater 15*b* of the $O_2$ sensor 15, an output of a terminal voltage of a current detecting resistor 28 and a terminal of the detecting element 15*a* are connected to the A/D conversion input circuit 23, thus detecting an impression voltage of the heater 15*b*, an electromotive force generated on the detecting element 15*a* and a current flowing to the heater 15*b*.

On the other hand, the microcomputer 22 outputs a driving signal directly to the ignitor 16 and also outputs a control signal to the fuel injection valve 2 through the driving circuit 26, thereby driving these actuators.

In ECU 21 of this embodiment constructed as above, an operating state of the engine 1 is read and various control processes are executed thereon, however, since oxygen density parameters are used for fuel injection rate control, air fuel ratio control and others, an oxygen density in exhaust gas of the engine 1 is detected, and an air fuel ratio correction factor will be computed according to the detected result.

Next, an air fuel ratio correction factor computing process to be executed by the ECU 21 will be described with reference to the flowchart given in FIG. 3.

The air fuel ratio correction factor computing process is carried out at every predetermined time (several ms in the embodiment).

First, whether or not feedback (F/B) execution conditions to a desired air fuel ratio (theoretical air fuel ratio ($\lambda=1$)) have been realized is decided according to an engine operating state detected by each sensor in STEP 100. For example, a determination is made of whether or not the conditions that the engine has already been warmed up with a cooling water temperature at 80° C. or over, the engine has already been started up, a throttle opening is not enough to indicate a high load, a rotational frequency is not high (3,500 rpm or over), not accelerated, a fuel is not cut and so forth are all determined. Then, where it is decided that F/B execution conditions are not realized, the process is closed, but where realized to the contrary, the process moves forward to STEP 101, where an output voltage OX of the $O_2$ sensor 15 this time is read. In the next STEP 102, which one is identified by the map pattern (FIG. 4) selected in an air fuel ratio deviation computing pattern selecting process (FIG. 8) which will be described hereinlater is decided, and a deviation $\Delta\lambda$ of a practical air fuel ratio $\lambda$ to a theoretical air fuel ratio $\lambda_0$ is computed in STEPS 103, 104 or 105 according to the pattern. That is, $\Delta\lambda$ will be obtained through $\lambda-\lambda_0$.

Figure 4:
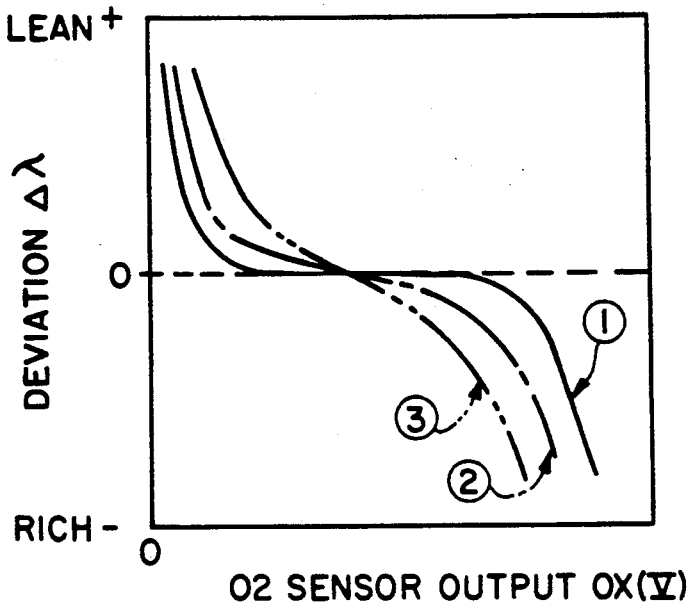
FIG. 4, FIG. 5 and FIG. 6 are characteristic diagrams showing patterns of a map used in the process illustrated in FIG. 3.

Patterns ①, ②, ③ indicated in FIG. 4 are all stored beforehand separately in ROM 22*b*, determined on an output characteristic of the $O_2$ sensor 15 to an air fuel ratio of the mixed gas supplied to the engine, and each pattern is decided corresponding to a change in the output characteristic due to a deterioration of the $O_2$ sensor 15.

Figure 6:
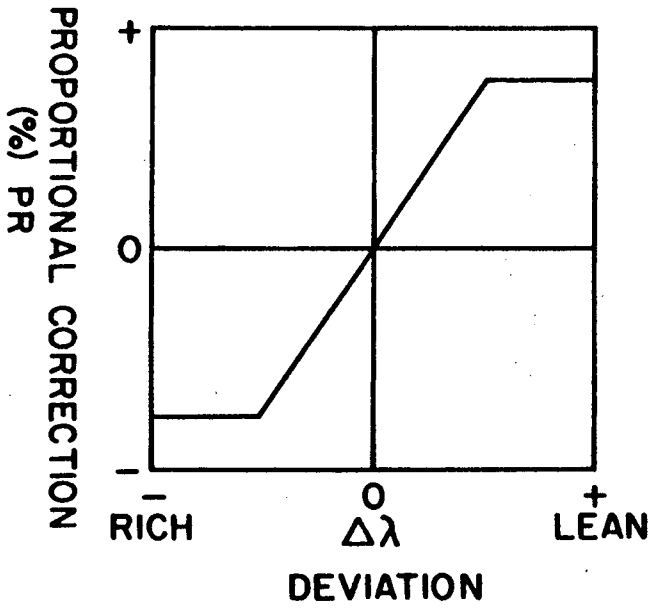
Figure 5:
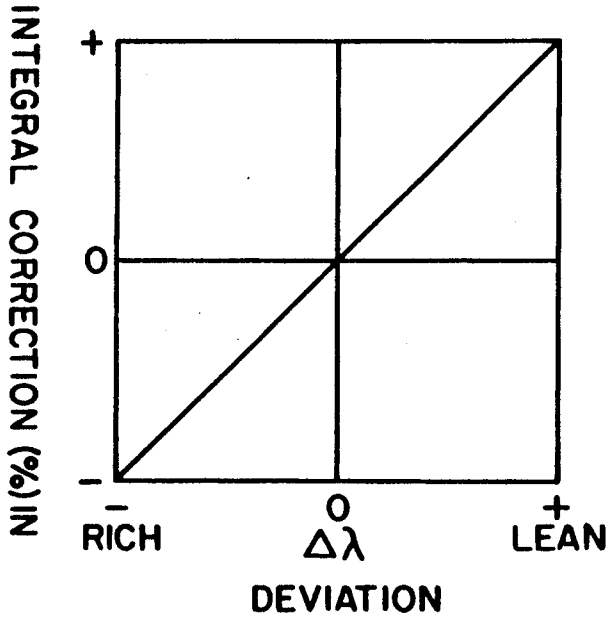

In the ensuing STEP 106, an integral correction value IN and a proportional correction value PR are obtained corresponding to the above air fuel ratio deviation $\Delta\lambda$ through an integral value map shown in FIG. 5 and a proportional value map shown in FIG. 6 which are stored in ROM 22*b*. That is, when $\Delta\lambda>0$ (the air fuel ratio coming on a lean side), IN and PR are both positive, but when $\Delta\lambda>0$ (the air fuel ratio coming on a rich side), IN and PR are both negative. Then, as will be described herein, where a deterioration arises on the $O_2$ sensor 15, the, air fuel ratio deviation $\Delta\lambda$ will be computed to large value as compared with the case where the deterioration does not arise, regardless of whether the $O_2$ sensor outputs are the same.

Then, the process moves forward to STEP 107, where the proportional correction value PR and the integral correction value IN obtained through the foregoing STEP 106 are added to a previous air fuel ratio correction factor FAF stored in RAM 22*c*, that is, air-fuel correction value is integrated, the air fuel ratio correction factor this time is computed from subtracting the previous proportional correction value PRO, and is stored in RAM 22c as the air fuel ratio correction factor FAF to be used for the next routine.

Next in STEP 108, the proportional correction value PR obtained through the foregoing STEP 106 is stored in RAM 22c as the proportional correction value PRO to be used for the next routine, thus closing the process.

Then, ECU 21 determines an effective injection time Te from multiplying and correcting a basic injection time Tp determined by intake pressure and rotational frequency computed through the aforementioned air fuel ratio correction factor computing process in a well-known fuel injection rate computing process, and further determines a driving pulse time width of the fuel injection valve 2 from multiplying and correcting an ineffective injection time according to the battery voltage. A pulse signal of the driving pulse time width thus determined is impressed on the injection valve 2, thereby subjecting an air fuel ratio of the mixed gas supplied to the engine 1 to a feedback control to a desired (theoretical) air fuel ratio or close.

Figure 7:
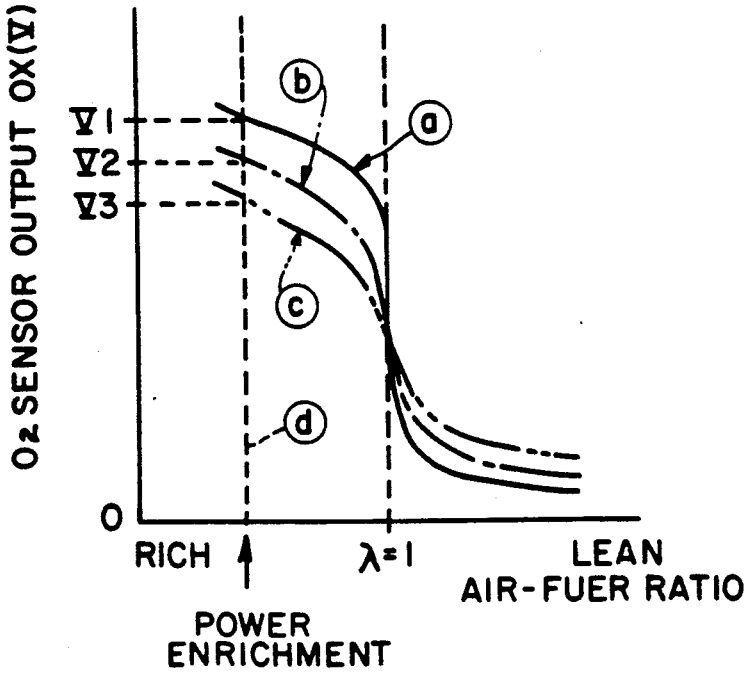
FIG. 7 is a characteristic diagram showing an output characteristic of $O_2$ sensor to an air fuel ratio.

Meanwhile, as described hereinabove, the output characteristic of the $O_2$ sensor 15 to the air fuel ratio changes, due to a deterioration (secular change), from an initial characteristic (a) to characteristics (b), (c) as shown in FIG. 7. As will be apparent from FIG. 7, as the $O_2$ sensor deteriorates, a width of the output voltage variation to a change of the air fuel ratio gets smaller. Consequently, in consideration of these characteristic changes from (a) to (c), the air fuel ratio deviation $\Delta\lambda$ is computed by means of the selected map pattern of FIG. 4 as described above. The map pattern of FIG. 4 indicates that a deviation from a theoretical value of the air fuel ratio must be amplified to computation according as the deterioration goes regardless of the output voltage being the same in consideration of the characteristics shown in FIG. 7 that when the air fuel ratio gets rich, an output voltage of the $O_2$ sensor is low according as the deterioration goes regardless of the air fuel ratio being same, and when it comes on a lean side to the contrary output voltage is high. In this connection, if a definite map pattern is used without taking the deterioration into consideration, the air fuel ratio deviation $\Delta\lambda$ cannot be computed correctly from the then output of $O_2$ sensor 15 due to a difference between the actual characteristic and the characteristic when the map pattern was determined, and thus a deterioration in control precision of the air fuel ratio may result. Accordingly, the map patterns (1), (2), (3) are determined on the basis of theoretical air fuel ratio ($\lambda=1$) according to the characteristics (a), (b), (c) of FIG. 7 respectively.

Figure 8:
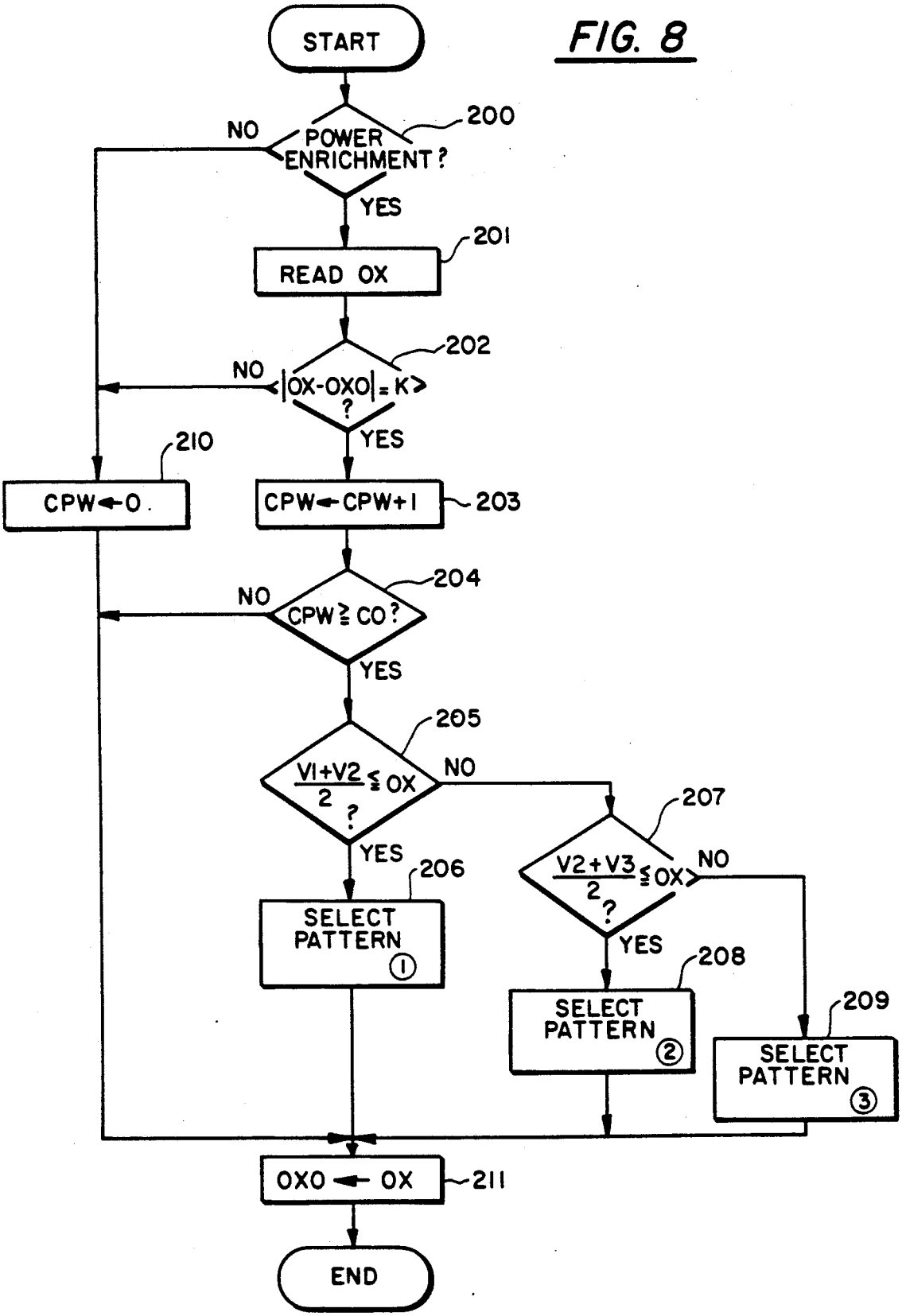
FIG. 8 is a flowchart showing an air fuel ratio deviation computing pattern selecting process.

Next, the air fuel ratio deviation computing pattern selecting process for deciding which map pattern of those of FIG. 4 to select according to a degree of deterioration of the $O_2$ sensor will be described with reference to FIG. 8. The process shown in FIG. 8 is carried out at every predetermined time. First, in STEP 200 whether or not the throttle valve 10 is opened from a predetermined opening indicating a high load, that is, an increase in output of the fuel (enrichment of the air-fuel mixture) is decided for the current operating state, and if increasing in output, then the process moves forward to STEP 201, and the present output voltage OX of the $O_2$ sensor 15 is read. When the output is increasing, a feedback control condition of the air fuel ratio is not realized, and hence a mixed gas supplied to the engine is thickened more than the desired air fuel ratio regardless of a signal from the oxygen density sensor. In STEP 201, a deterioration of the sensor 15 is detected from an output voltage of the sensor 15 in the thickened state.

Next in STEP 202, whether or not an absolute value of the deviation between output voltage OX of the $O_2$ sensor 15 read in STEP 201 and output voltage OXO read in the previous process is smaller than a predetermined value K is decided, and if smaller, the process moves forward to STEP 203. In STEP 203 a counter CPW is incremented, and STEP 204 determines whether or not the counter CPW indicates a predetermined value $C_0$ or over. Where decided as $CPW \geqq C_0$ in STEP 204, the process moves forward to STEP 205 on.

In the aforementioned process through STEPS 200 to 204, a control of the output increment is carried out continuously, and the situation that the air fuel ratio is kept almost stable continuously for a predetermined time or longer by the increment in a state richer than the theoretical air fuel ratio indicated by a broken line (d) in FIG. 7 is detected. In such state, as shown in FIG. 7, the output voltage OX of the sensor 15 will indicates $V_1$ to determine the initial characteristic (a) where the $O_2$ sensor 15 is not deteriorated, but the output voltage OX drops to $V_2$, $V_3$ as it deteriorates. Accordingly, in STEP 205 and thenceforward, which map pattern of FIG. 4 to select is decided based on which of $V_1$, $V_2$, $V_3$ is closest to the output voltage OX. Then, as will be apparent from FIG. 7, the output voltage of the $O_2$ sensor 15 settles at the theoretical air fuel ratio ($\lambda=1$) or around regardless of a deterioration of the $O_2$ sensor 15, therefore whether or not the state richer than the theoretical air fuel ratio is kept on is decided especially in STEPS 200 to 204 to ensure a detection of deterioration.

In STEP 205 a first comparison voltage $(V_1+V_2)/2$ and the output voltage OX of the $O_2$ sensor 15 are compared, and if $(V_1+V_2)/2 \leqq OX$, then it is decided that almost no deterioration, and the map pattern (1) is selected in STEP 206. Then, if not $(V_1+V_2) \leqq OX$, then a second comparison voltage $(V_2+V_3)/2$ and the output voltage of the $O_2$ sensor 15 are compared, and if $(V_2+V_3)/2$ and the output voltage OX of the $O_2$ sensor 15 are compared, and if $(V_2+V_3)/2 \leqq OX$, the process moves forward to STEP 208, and the map pattern (2) is selected according to a degree of deterioration of the $O_2$ is selected according to a degree of deterioration of the $O_2$ sensor 15, but if not $(V_2+V_3)/2 \leqq OX$, then the process moves forward to STEP 209, and the map pattern (3) is selected accordingly.

Then, where decided "NO" in the aforementioned STEPS 200 and 202, the counter CPW is reset in STEP 210.

When moving forward to STEP 211 by way of each STEP mentioned above, the $O_2$ sensor output voltage OX read this time is stored in RAM 22c as OXO for the next process in STEP 202, thus closing the process.

According to this embodiment, if the $O_2$ sensor 15 is deteriorated and hence the $O_2$ sensor output characteristic changes, then a degree of the change will be detected at the time when a predetermined operating state before the theoretical air fuel ratio continues for a predetermined time or longer, further an air fuel ratio change map pattern is modified correspondingly to the change, and the air fuel ratio deviation $\Delta\lambda$ is obtained from $O_2$ sensor output by means of the modified map pattern, therefore a change in the output characteristic of the $O_2$ sensor due to the deterioration is compensated and $\Delta\lambda$ will be determined accordingly. The deviation $\Delta\lambda$ is thus obtainable in precision, and the actual air fuel ratio can be controlled in precision to a desired theoretical air fuel ratio consequently. Then, the map pattern of FIG. 4 is not necessarily limited to three, but may be provided into two or four or over.

A second embodiment will be described next with reference to FIG. 9, FIG. 10 and FIG. 11.

Figure 9:
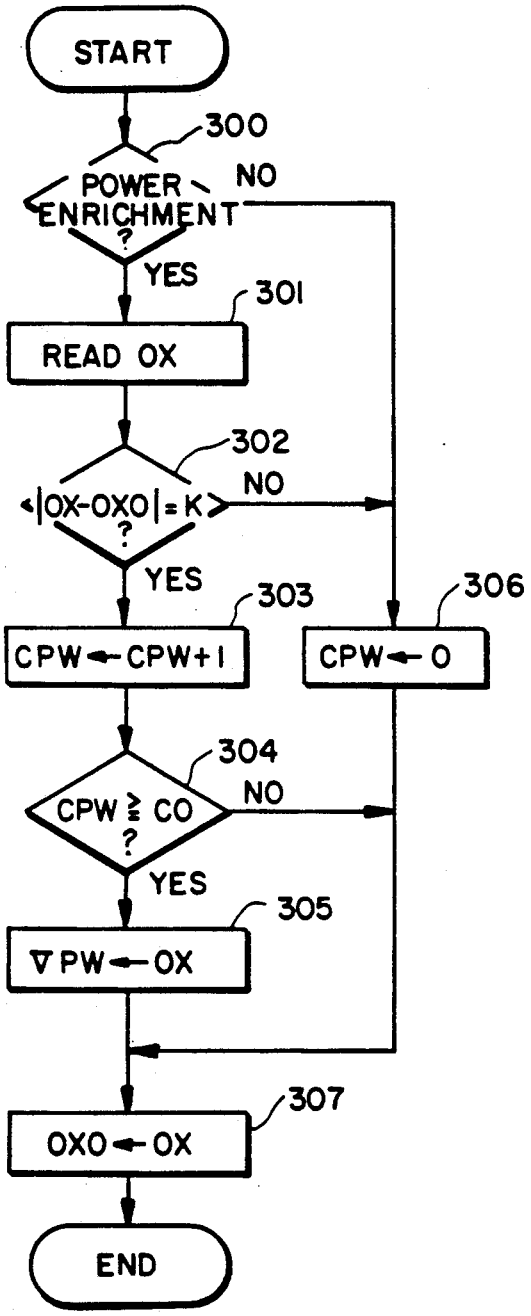
FIG. 9, FIG. 10 are flowcharts in a second embodiment of the invention.

The process given in FIG. 9 is also executed at every predetermined time, and STEPS 300 to 304, STEP 306 and STEP 307 are identical to STEPS 200 to 204, STEP 210 and STEP 211 in the process of the foregoing embodiment illustrated in FIG. 8. Then, in the process, a stabilized value VPW of the $O_2$ sensor output voltage OX at the time when the $O_2$ sensor output voltage OX is stabilized for a predetermined time or longer in an output increment is stored in STEP 305.

Figure 3:
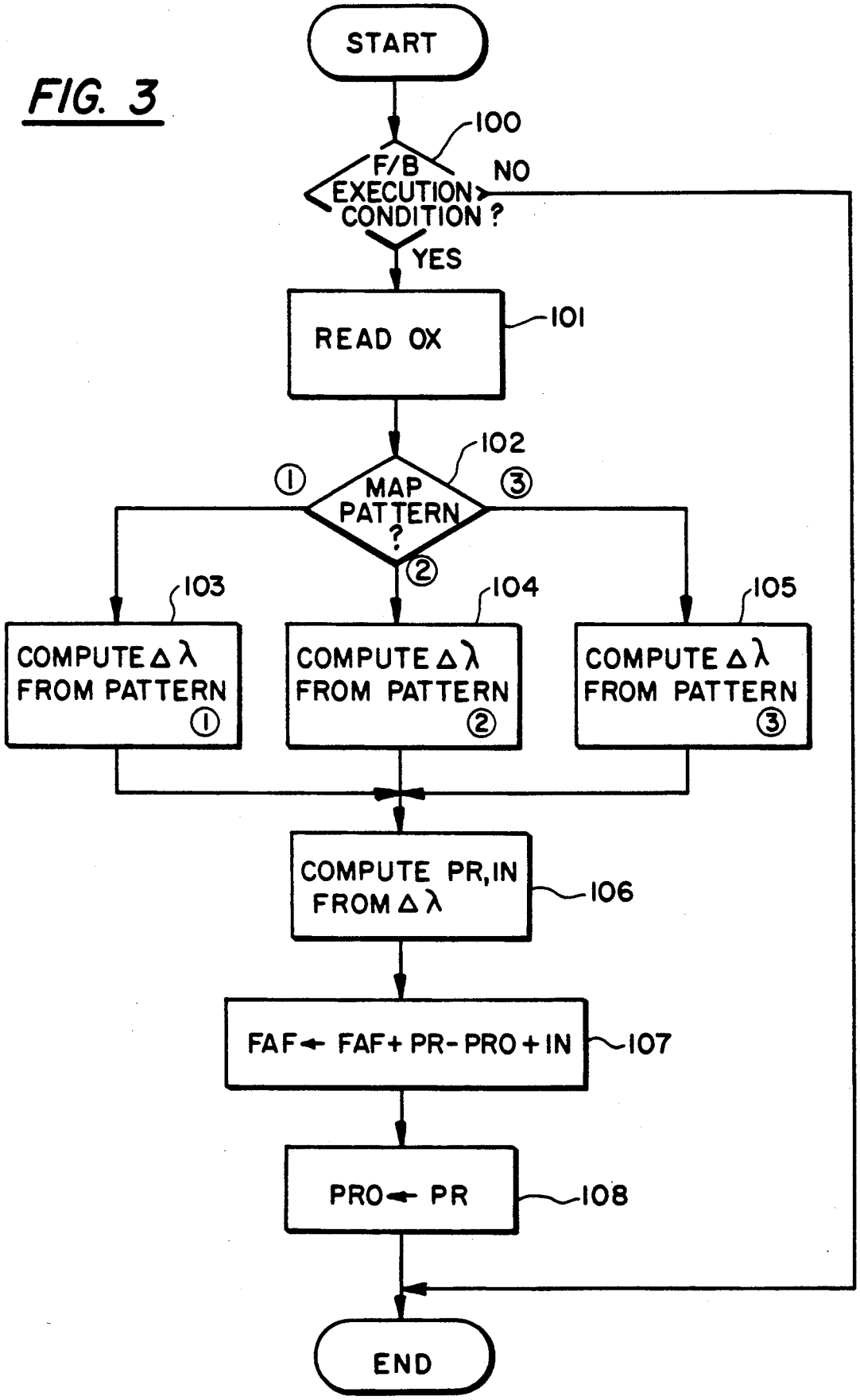
FIG. 3 is a flowchart showing an air fuel ratio correction factor computing process.
Figure 10:
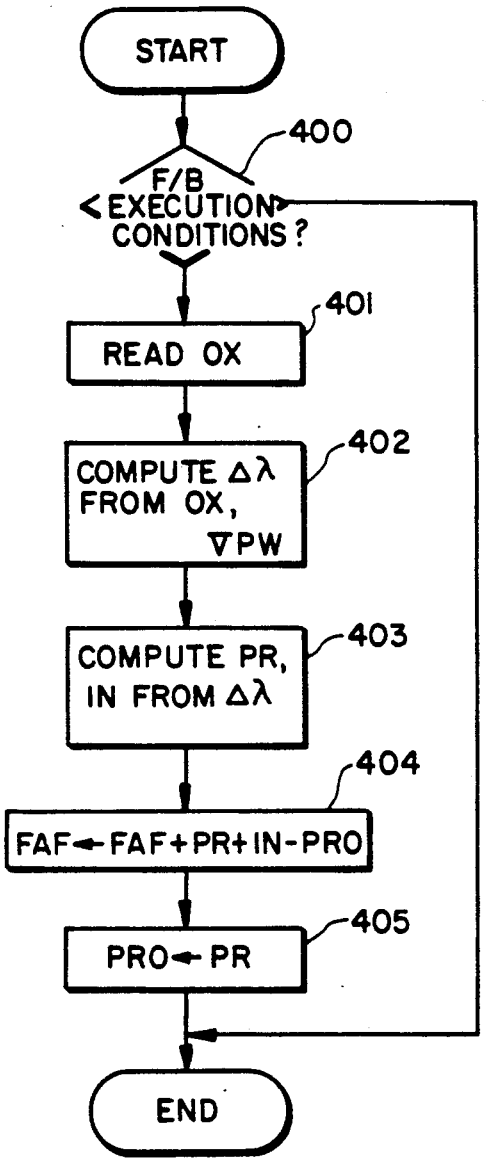

Then, in the process of FIG. 10, a process the same as that of STEP 100 and STEP 101 illustrated in FIG. 3 is carried out through STEP 400 and STEP 401 likewise, and then in STEP 402 the air fuel ratio deviation $\Delta\lambda$ is interpolated to computation on the stabilized voltage VPW obtained through the process of FIG. 9 and the $O_2$ sensor output voltage OX according to a two-dimensional map shown in FIG. 11.

Then, a content of the map of FIG. 11 is also determined on the $O_2$ sensor output characteristic like that of FIG. 7.

The process the same as that of the foregoing embodiment through STEPS 106, 107 and 108 illustrated in FIG. 3 is then executed through STEPS 403, 404 and 405 according to the deviation $\Delta\lambda$ thus obtained, thereby obtaining the air fuel ratio correction factor FAF this time.

A functional effect similar to the first embodiment will be obtainable through the above process. That is, a degree of deterioration of the $O_2$ sensor is detected in the state where an operating state in which the air fuel ratio has shifted to rich side continues for a predetermined time or longer, and an optimum value of $\Delta\lambda$ according to a degree of the deterioration is selected from within ROM 22*b* to use at the time of normal air fuel ratio feedback control.

As described above, according to the invention, a deviation of the acutal air fuel ratio to a desired air fuel ratio is obtainable despite change in characteristics due to a change in state of the oxygen density sensor, therefore it can be controlled in precision to the desired air fuel ratio for a long period of time. Then, an output characteristic change of the $O_2$ sensor will not particularly be decided when the air fuel ratio is kept rich. For example, such decision may be effected when the air fuel ratio is kept lean where a fuel cut state lasts long. In this case, as will be apparent from FIG. 7, the more a deterioration of the $O_2$ sensor advances, the higher an output voltage from the $O_2$ sensor becomes in value therefore a characteristic of $\Delta\lambda$ whereby a difference in the output voltage is compensated may be stored beforehand in ROM 22*b*.

What is claimed is:

1. An air-fuel ratio controller for an internal combustion engine comprising:

an oxygen density sensor provided in an exhaust system of said engine for detecting an oxygen density in an exhaust gas of said engine and generating an output signal indicative thereof;

memory means for storing a plurality of predetermined non-linear relationships between a) an air-fuel ratio deviation, and b) said oxygen density sensor output signal, over an entire range;

air fuel-ratio deviation determining means for determining a current air-fuel ratio deviation by using said output of said oxygen density sensor and one of said plural predetermined non-linear relationships stored in said memory means;

control variable setting means for setting an air-fuel ratio control variable according to said deviation determined by said air-fuel ratio deviation determining means;

air-fuel ratio control means for controlling an air-fuel ratio of mixed gas to be supplied to said engine toward said desired air-fuel ratio according to said control variable set by said control variable setting means;

characteristic change detection means for detecting a change in an output characteristic of said oxygen density sensor for a predetermined air-fuel ratio by using said output of said oxygen density sensor; and selection means for correcting said one of said plural predetermined non-linear relationships over said entire range corresponding to a detection result of said characteristic change detection means.

2. An air-fuel ratio controller according to claim 1, wherein said memory means stores a plurality of relationships between said air-fuel ratio deviation and said oxygen density sensor output and wherein said correction means selects one of said plural relationships stored in said memory means as a selected relationship corresponding to said detection result of said characteristic change detection means.

3. An air-fuel ratio controller according to claim 2, wherein each of said plural relationships are determined corresponding to a difference in a magnitude or said output of said oxygen density sensor generated in a specific operating state.

4. An air-fuel ratio controller according to claim 3, wherein said plural relationships are stored in said memory means as two-dimensional maps.

5. An air-fuel ratio controller according to claim 1, wherein said characteristic change detecting means detects a characteristic change of said oxygen density sensor according to a magnitude of said oxygen density sensor output generated in a specific operating state of said internal combustion engine.

6. An air-fuel ratio controller according to claim 5 wherein said specific operating state is a state where air-fuel ratio of mixed gas to be supplied is enriched.

7. An air-fuel ratio controller according to claim 1, wherein said selection means corrects a magnitude of said air-fuel ratio deviation determined by said air-fuel ratio deviation determining means to a larger value for the same output of said oxygen density sensor when a deterioration of said oxygen density sensor is detected by said characteristic change detection means than when one is not detected.

8. An air-fuel ratio controller according to claim 1 further comprising:

air-fuel ratio enriching means for enriching said air-fuel ratio of said mixed gas to be supplied to said engine more than said desired air-fuel ratio regardless of said signal coming from said oxygen density sensor when said engine operates in a specific state, and said characteristic change detection means detecting said change in said output characteristic of said oxygen density sensor in a state where said air-fuel ratio of said mixed gas is enriched more than said desired air-fuel ratio by said air-fuel ratio enriching means.

9. An air-fuel ratio controller for an internal combustion engine comprising:

an oxygen density sensor provided in an exhaust system of said engine for detecting an oxygen density in an exhaust gas of said engine and generating an output signal indicative thereof;

memory means for storing at least one predetermined relationship between an air-fuel ratio deviation and an oxygen density sensor output over an entire range of operation;

air-fuel ratio deviation determining means for determining a current air-fuel ratio deviation corresponding to said output signal of said oxygen density sensor on the basis of said relationship stored in said memory means;

control variable setting means for setting an air-fuel ratio control variable according to said deviation determined by said air-fuel ratio deviation determining means;

air-fuel ratio control means for controlling an air-fuel ratio of mixed gas to be supplied to said engine toward said desired air-fuel ratio in response to said control variable set by said control variable setting means;

operating state detection means for detecting an operating sate of said engine;

decision means for determining that a condition wherein said operating state detected by said operating state detecting means reaches a predetermined operating state;

characteristic change detection means for detecting a change in an output characteristic of said oxygen density sensor for a predetermined air-fuel ratio when said condition is determined by said decision means; and correction means for correcting said relationship stored in said memory means over said entire range corresponding to a detection result of said characteristic change detection means.

10. An air-fuel ratio controller according to claim 9, wherein said characteristic change detection means detects said change in said output characteristic of said oxygen density sensor when the realized condition determined by said decision means lasts for more than a predetermined time.

11. An air-fuel ratio controller according to claim 9, wherein plural relationships between said air fuel ratio deviation and said oxygen density sensor output are stored in said memory means, and said correction means selects one of said plural relationships stored in said memory means as a selected relationship corresponding to said detection result of said characteristic change detection means.

12. An air-fuel ratio controller according to claim 11, wherein said plural relationships are stored in said memory as a plurality of maps each determined corresponding to a difference in a magnitude of said oxygen density sensor output generated in a specific operating state.

13. An air-fuel ratio controller according to claim 12, wherein each of said plural relationships are stored in said memory means as a two-dimensional map for computing said air-fuel ratio deviation based on said oxygen density sensor output generated in said specific operating state and in an occasional operating state as parameters.

14. An air-fuel ratio control system for an engine comprising:

air-fuel ratio detecting means for detecting an air-fuel ratio of a mixture supplied to said engine;

memory means for storing therein a predetermined relationship between an air-fuel ratio of mixture and an output of said air-fuel ratio detecting means over an entire range;

deviation detecting means for detecting, from said predetermined relationship, a deviation of said detected air-fuel ratio from a desired air-fuel ratio;

correction value setting means for setting a correction value in response to said detected deviation, said correction value being variable in proportion to said detected deviation;

integrating means for integrating said correction value set by said setting means;

mixture control means for controlling, in accordance with an output of said integrating means, an air-fuel ratio of mixture to be supplied to said engine;

deterioration detecting means for detecting a deterioration of said air-fuel ratio detecting means; and correction means for correcting said predetermined relationship over said entire range in response to said detected deterioration.

15. An air-fuel ratio control system as set forth in claim 14, wherein said deterioration detecting means comprises:

enrichment detecting means for detecting enrichment of air-fuel ratio of mixture to be supplied to said engine; and discriminating means for discriminating, in response to the detected enrichment, whether said air-fuel ratio detecting means is deteriorated in accordance with a magnitude of said output of said air-fuel ratio detecting means.

16. An air-fuel ratio control system as set forth in claim 14, wherein said memory means stores a plurality of relationships between said air-fuel ratio of mixture and said output of said air-fuel ratio detecting means and said relationships vary from each other in dependence on the degree of deterioration of said air-fuel ratio detecting means, and wherein one of said relationships is selected in response to an output of said deterioration detecting means.

17. An air-fuel ratio control system as set forth in claim 16, wherein said deterioration detecting means is responsive to a magnitude of said output of said air-fuel ratio detecting means at the time of enrichment of said air-fuel mixture to be supplied to said engine.

18. An air-fuel ratio apparatus for an internal combustion engine comprising:

an oxygen density sensor, located in a path of an exhaust gas of said engine, for determining an oxygen density in the exhaust gas of said engine and generating an oxygen density sensor output signal indicative thereof;

memory means for storing a plurality of predetermined non-linear relationships between an air-fuel ratio and said oxygen density sensor output signal, each relationship being over an entire range of operation of said oxygen density sensor output;

characteristic change detection means for detecting a change in an output characteristic of said oxygen density sensor for a predetermined air-fuel ratio using said output of said oxygen density sensor;

selection means for correcting at least one of said plural predetermined non-linear relationships to produce corrected non-linear relationships over said entire range corresponding to a detection result of said characteristic change detection means;

means for determining a current air-fuel ratio deviation by using said output of said oxygen density sensor and one of said corrected non-linear relationships stored in said memory means; and air-fuel ratio control means for controlling an air-fuel ration of mixed gas to be supplied to said engine toward a desired air-fuel ratio based on said current air-fuel ratio obtained based on said corrected non-linear relationships.

19. An apparatus as in claim 18, wherein said air fuel ratios stored by said memory means are air fuel ratio deviations, and further comprising:

air-fuel-ratio deviation determining means for determining a current air-fuel ratio deviation by using said output of said oxygen density sensor and said selected relationship.

20. An apparatus as in claim 19, further comprising:

control variable setting means for setting an air-fuel ratio control variable according to said deviation determined by said air-fuel ratio deviation determining means; and wherein said air-fuel ratio control means controls an air-fuel ratio of mixed gas to be supplied to said engine toward said desired air-fuel ratio according to said control variable set by said control variable setting means.

21. A method of controlling an air-fuel ratio in an internal combustion engine comprising the steps of:

detecting an oxygen density in an exhaust gas of said engine and generating an output signal indicative thereof;

storing a plurality of predetermined relationships between an air-fuel ratio and said oxygen density output signal, each said relationship being over an entire range of operation;

detecting a change in an output characteristic of said oxygen density output signal for a predetermined air-fuel ratio;

correcting at least one of said plural predetermined non-linear relationships to produce corrected non-linear relationships over said entire range;

determining a current air-fuel ratio deviation by using said oxygen density output signal and one of said corrected non-linear relationships; and controlling an air-fuel ratio of mixed gas to be supplied to said engine toward a desired air-fuel ratio based on said corrected non-linear relationships.

22. A method as in claim 21, wherein said air fuel ratio parameter is an air fuel ratio deviation, and comprising the further steps of:

setting an air-fuel ratio control variable according to said determined deviation; and wherein said controlling step includes controlling an air-fuel ratio of mixed gas to be supplied to said engine toward said desired air-fuel ratio according to said control variable.

* * * * *